United States Patent [19]

Soligny, Sr.

[11] Patent Number: 4,861,020

[45] Date of Patent: Aug. 29, 1989

[54] EXERCISE DEVICE FOR INSTALLATION IN A DOORWAY

[76] Inventor: Robert E. Soligny, Sr., 600 NE. 128 St., N. Miami, Fla. 33161

[21] Appl. No.: 146,578

[22] Filed: Jan. 19, 1988

[51] Int. Cl.[4] ..... A63B 1/02

[52] U.S. Cl. ..... 272/62; 272/136; 272/142; 272/900

[58] Field of Search ..... 272/62, 63, 131, 136, 272/137, 142, 900

[56] References Cited

U.S. PATENT DOCUMENTS

| | | | |
|---|---|---|---|
| 3,226,115 | 12/1965 | Underhill | 272/900 X |
| 3,342,484 | 9/1967 | Christensen | 272/62 X |
| 4,241,914 | 12/1980 | Bushnell | 272/62 X |
| 4,328,964 | 5/1982 | Walls | 272/900 X |
| 4,657,242 | 4/1987 | Guridi | 272/900 X |
| 4,685,670 | 8/1987 | Zinkin | 272/900 X |

FOREIGN PATENT DOCUMENTS

| | | | |
|---|---|---|---|
| 2037451 | 2/1971 | Fed. Rep. of Germany | 272/136 |

*Primary Examiner*—Richard J. Apley
*Assistant Examiner*—Robert W. Bahr

[57] ABSTRACT

A stationary exercise apparatus to be affixed in a standard door jamb comprises a trio of rectangular support members, and a curved gym bar, using looped end extension springs as a source of resistance each support member is provided with independent sections and each section comprising of a plurality of open ended eyelets with spring guides adapted to receive the looped ends of one or more extension springs, the upper support member is affixed to the top portion of the jamb facing downward, a pair of vertical support members facing in a bi-lateral relation on each side of the door jamb. To use the apparatus, one or more extension springs with looped end is placed over the spring guide of the open end eyelet of the curved gym bar and the other end of the spring is attached in the same manner to one of the eyelets on the upper support member using the same attaching method and two extension springs, a curved bar is used with the two vertical support members, all of which will allow for a push and pull motion of exercise allowed for by the independent sections of the eyelets. The extension springs allows use of auxiliary equipment such as hand grips and V-shaped bars.

5 Claims, 4 Drawing Sheets

EXERCISE DEVICE FOR INSTALLATION IN A DOORWAY

SUMMARY OF THE INVENTION

The invention is a versatile fitness system which utilizes no floor space and remains permanently affixed in the confines of any standard door jamb.

The invention is comprised of a system of three independent support rails acting as the embodiment of the invention which incorporate the use of seven multiple hook sections. Each section is comprised of four connecting hooks. The header support rail has one section of four connecting hooks and the left and right vertical support rails have three sections of four connecting hooks each. The connecting hooks are the supporting factor in the employment of the eight extension springs that are the source of resistance in the invention which are then attached to the two hand grips that are employed in the invention. They are gripped by the user in the performance of physical exercises.

The invention employs the use of a reversible bar having two sections of four connecting hooks each, one section located on the top side and one section of four connecting hooks located on the bottom side of the reversible bar. The reversible bar will employ the use of the extension springs which are thereby attached to the connecting hooks on the support rails.

The invention has been designed to provide many, well rounded physical fitness workout programs through a large number of routines designed for body building—fitness conditioning and muscle toning, while staying within the safe ranges of light, medium and heavy impact programs, as well as aerobic conditioning to strengthen the heart and respitory system.

This system is also designed, to aid in physical thereapy and fitness programs that have been specifically designed for those who have physical disabilities and are confined to the use of a wheel-chair.

The variations of intensity of the workout programs are regulated by the number of extension springs in use thereof, but manufacturers preference may be otherwise.

The invention may as a secondary source of resistance employ the use of surgical tubing, bon-gee cord, and expand and contractable elastic cords.

DESCRIPTION OF THE PREFERRED EMBODIMENT

Figure 1:
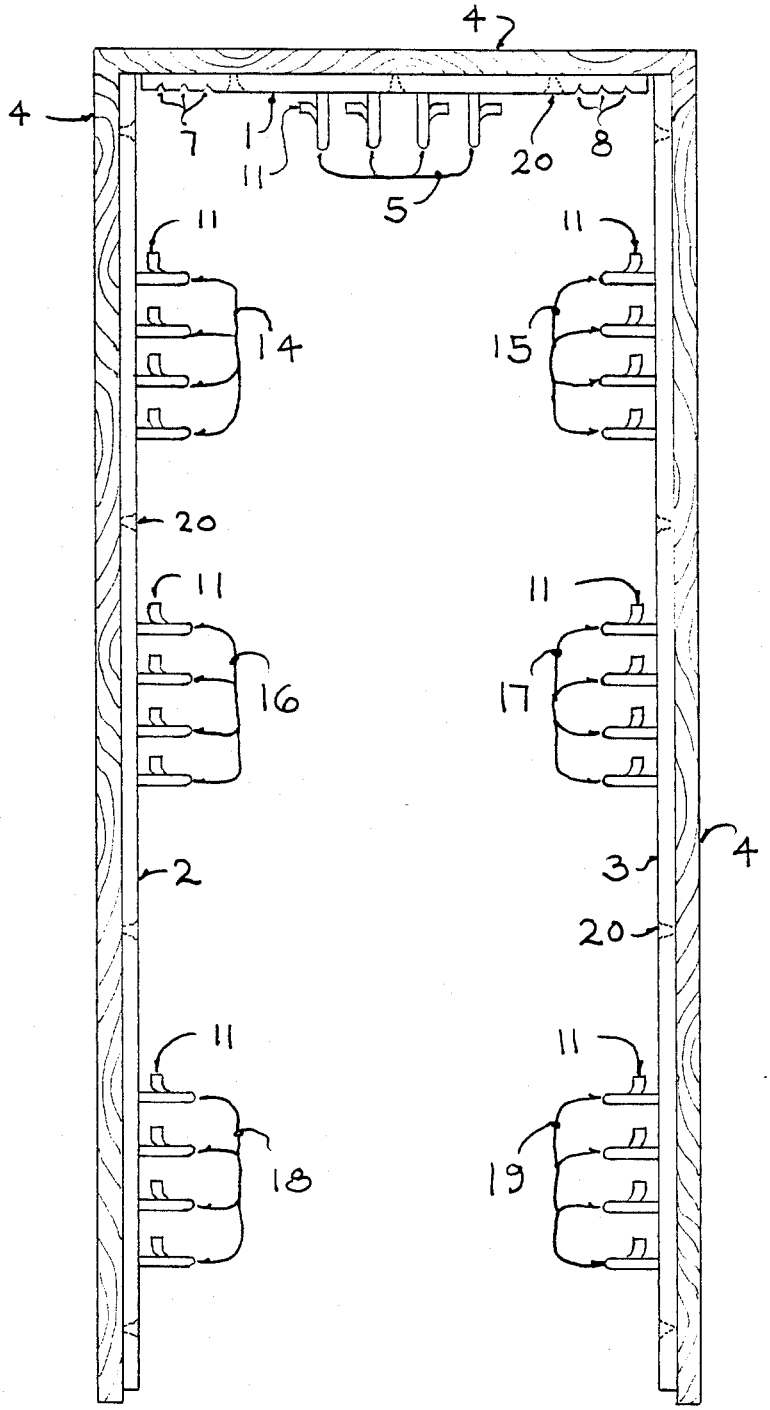
FIG. 1 is a perspective view of the embodiment of the invention installed on a standard door jamb 4. The drawing shows a system of three independent support rails. They are the header support rail 1, the left vertical support rail 2, and right vertical support rail 3, with the connecting hook sections 5, 14, 15, 16, 17, 18 and 19, and the spring guides 11. Also shown, the pre-cut slots 7 and 8, on the header support rail 1.
Figure 2:
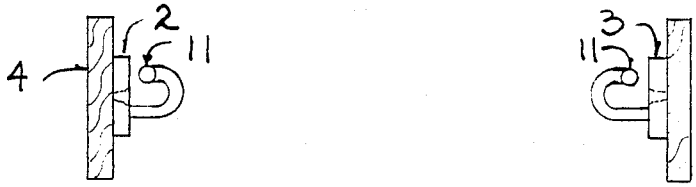
FIG. 2 is a top view of the door jamb 4 with the left vertical support rail 2 and right vertical support rail 3 showing a true perspective of the connecting hooks and the spring guides 11.
Figures 6, 7:
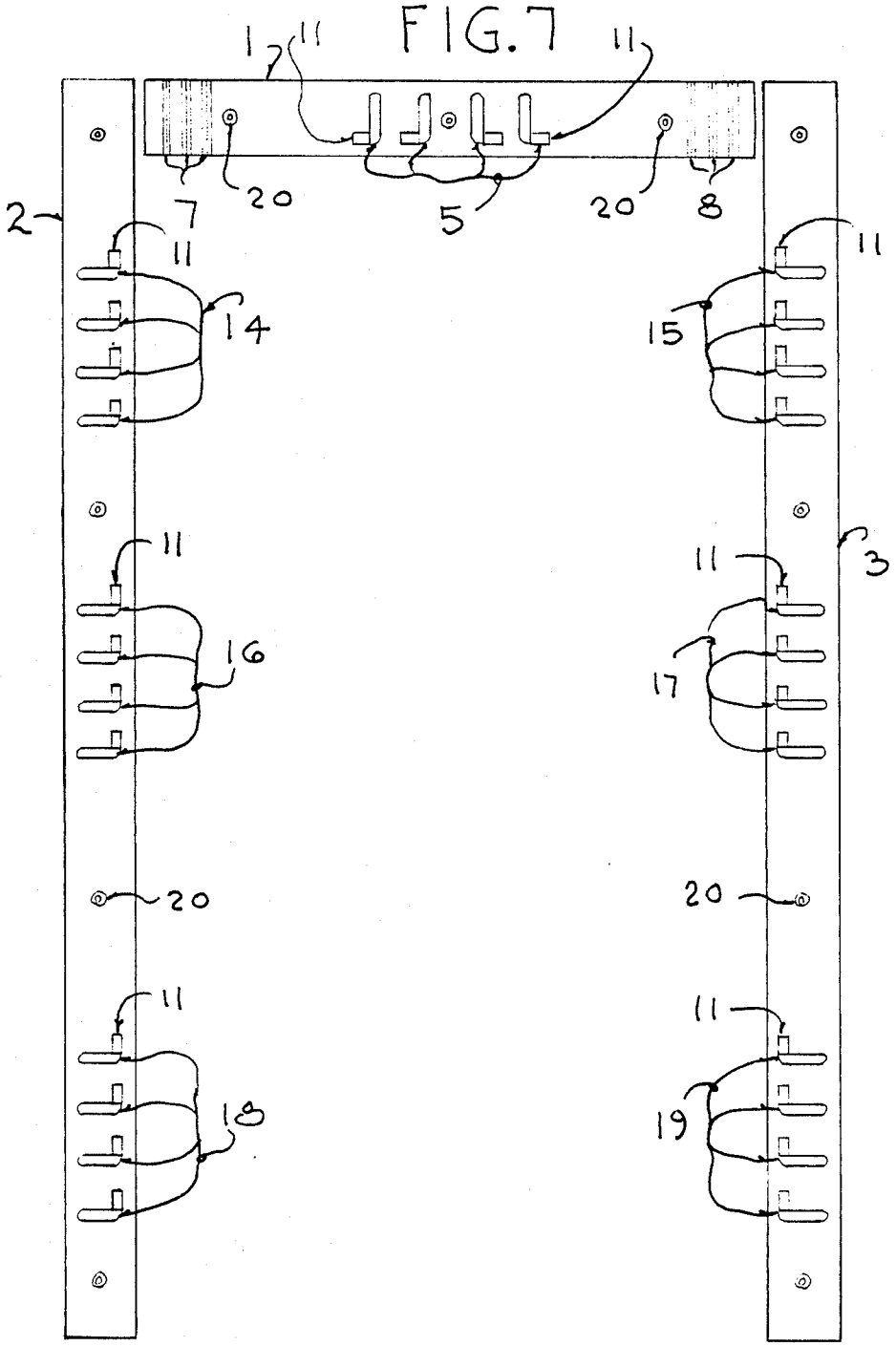
FIG. 6 is a front vertical view of the left vertical support rail 2 and right vertical support rail 3.
FIG. 7 is a front, horizontal view of the header support rail 1. The drawing shows the pre-cut slots 7 and 8.
Figure 8:
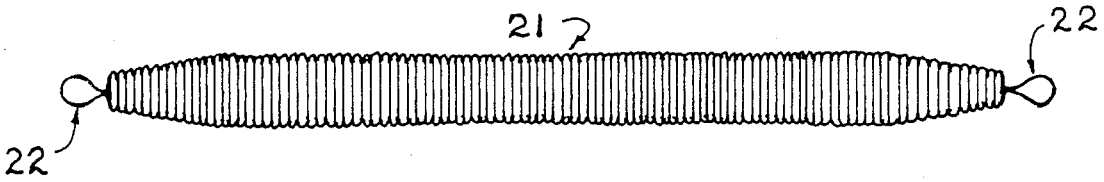
FIG. 8 is a perspective view of the extension spring 21.

The header support rail 1, FIGS. 1 and 7 has located in the center, one section comprised of four connecting hooks, section 5. The connecting hooks are spaced one inch apart and securely welded, they are the supporting factor in the employment of the extension springs, not shown. The extension springs are the source of resistance employed by the invention.

The header support rail 1, is twenty nine and one quarter inch in length, it has incorporated into it six pre-cut slots 7 and 8. The slots may be cut or snapped off, they are designed to allow for the reduction in the length of the header support rail 1. The six pre-cut slots 7 and 8 are located, three on the left side 7 and three on the right side 8. They are in one-inch increments, this will give a six inch overall reduction allowance of the total length of the twenty nine and one quarter inch header support rail 1. When necessary this will provide for the installation on narrower door jambs. The header support rail 1, measuring twenty nine and one quarter inch in length, will accommodate all standard door jambs above this width.

The four connecting hooks, section 5 located on the header support rail 1, are shown with two of the spring guides 11 turned to the left side, and two of the spring guides 11 turned to the right side. The purpose of this is to give a balanced perspective in their appearance only.

The numeral 11 represents the thirty six spring guides 11 on the thirty six connecting hooks in sections 5, 9, 10, 14, 15, 16, 17, 18 and 19, employed by the invention.

Shown in FIGS. 1, 2, 4, 5 and 6 are the left vertical support rail 2 and the right vertical support rail 3. The rails have three sections comprised of four connecting hooks each, 14, 15, 16, 17, 18 and 19. The connecting hooks are spaced one-inch apart, they are the supporting factor in the employment of the extension springs. The extension springs are employed in conjunction with the two hand grips employed by the invention, not shown.

The measurements between the connecting hook sections located on the vertical support rails 2 and 3.

The top connecting hook sections 14 and 15 measuring from the top of the spring guides 11, located on the sections 14 and 15 to the bottom of the header support rail 1 are eighteen inches apart.

The middle connecting hook sections 16 and 17 measuring from the top of the spring guides 11 located on the sections 16 and 17 to the bottom connecting hook of sections 14 and 15 have a distance of twenty inches apart.

The bottom connecting hook sections 18 and 19 measuring from the top of the spring guides 11 located on the sections 18 and 19 to the bottom connecting hook of sections 16 and 17 have a distance of twenty three inches apart.

The overall length of the vertical support rails 2 and 3 measure eighty and one half inches in length. The header support rail 1, overall length is twenty nine and one quarter inches in length. The three support rails, measure one and one quarter inches in width and one quarter inch in thickness. They are constructed of low carbon steel.

The method used to incorporate the connecting hooks into the embodiment of the support rails, all of the connecting hooks are welded from the front and the back side, three sixteenth of one inch holes are thereby drilled one inch apart on the face side of the support rails, thereafter on the reverse side the holes are thereby countersunk to a depth of three-thirty seconds of one inch.

The connecting hooks measuring three-sixteenth of one inch in diameter, are thereby placed through the holes and securely welded from the reverse side where the holes have been countersunk, thereby giving a nail head type structure to the end of the connecting hooks.

Figure 5:
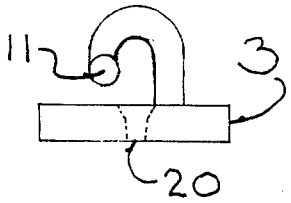
FIG. 5 is a full scale top view of vertical support rail 3 showing connecting hook and spring guide 11, with countersunk screw holes 20.

The connecting hooks shown, FIG. 5 top view, extend five-eights of one inch from the vertical support rail 3, FIG. 5.

The numeral 20 represents the bevel headed screw holes in FIGS. 1, 2, 5, 6 and 7. These will accommodate the one quarter of an inch by two and one half inch flat headed phillips screws, thereby giving a flush surface to the screws, and the support rails 1, 2 and 3. The screws are the supporting factor when securing the header support rail 1 and the two vertical support rails 2 and 3, to a door jamb.

Figure 3:
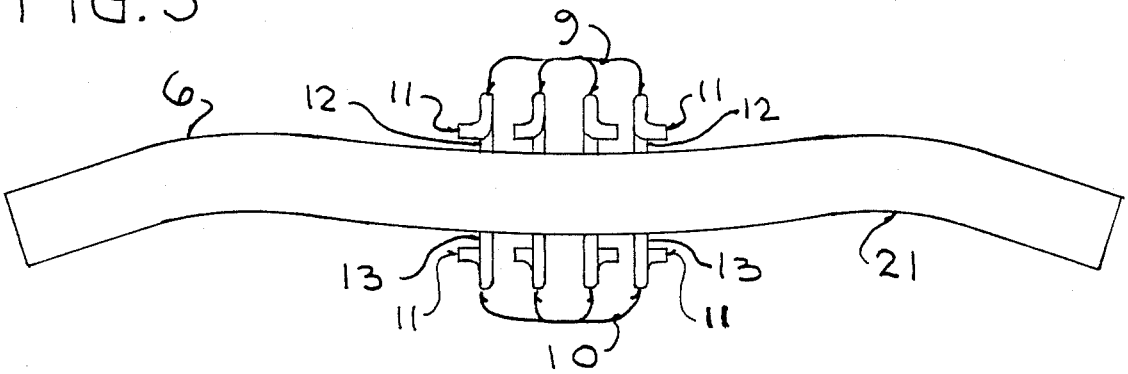
FIG. 3 is a perspective view of the twenty one inch reversible bar 6. It has two connecting hook sections, each comprised of four connecting hooks, they are the top section 9 and the bottom section 10. Top section 9 shown with the open side 12 of the connecting hooks. Bottom section 10 shown with the backside 13 of the connecting hooks. Reversible bar 6 has a twenty degree angle 21 located six inches from each end of the bar on the bottom side and fifteen degree slope at the top of the bar located six inches from the ends of the bar to the center.
Figure 4:
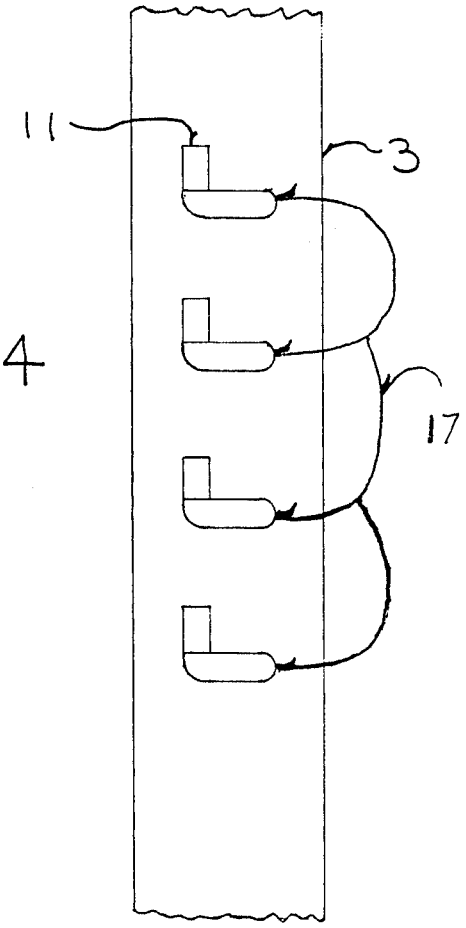
FIG. 4 is a front full scale sectional view of the right vertical support rail 3, showing the connecting hook section 17 and the spring guides 11.

The reversible bar 6, FIG. 3 is shown with the four connecting hooks, section 9 located at the top of the bar are shown with the open side 12 of the connecting hooks, section 9. Two of the spring guides 11 on the hooks are turned to the left side and two spring guides 11 are turned to the right side of the reversible bar 6.

The four connecting hooks, section 10 located at the bottom of the reversible bar 6 shown with the back side 13 of the connecting hooks, section 10 two of the spring guides 11 on the hooks are turned to the left side and two spring guides 11 turned to the right side, the purpose of this is to work in conjunction with the connecting hooks sections 14, 15, 16, 17, 18 and 19, located on the vertical support rails 2 and 3. Each section of the connecting hooks employs the use of extension springs 21.

The loops 22 at the end of the extension springs 21 are placed over the spring guides 11, located on the connecting hooks, section 9 or 10 located on the reversible bar 6, depending on the type of exercise to be performed with the bar. One type of exercise with the reversible bar 6 and the header support rail 1, is performed by attaching any number of the extension springs 21 numbering from one to four to the connecting hooks, section 5 then attaching the opposite end of the springs 21 to the connecting hoooks, section 9 located on the top side of the bar. With this arrangement using the hooks at the top side of the bar, it is ready to perform the exercise with the user facing in the direction of the invention with both hands on the reversible bar 6, palms down and elbows to the sides of the user, with a pushing motion in a downward direction until both arms are straight, with an opposing force by the user, the bar is slowly raised to its starting position, completing one repetition of this type of exercise.

This is one of numerous exercises that can be performed with the combination of the header support rail 1 and the reversible bar 6 using the top section of connecting hooks 9.

The reversible bar 6 has been designed to be employed in conjunction with vertical support rail 2 and vertical support rail 3, in the performance of exercises in a sitting position, with employment of the two right side connecting hooks located on the bottom section of connecting hook 10 on the bar, by attaching one or two of the extension springs 21 to the hooks on the bar and the opposite end of the springs 21 are attached to the connecting hook, section 19 located on vertical support rail 3, this completes the connecting method of the right side.

By employing two left side hooks on the bottom section of connecting hooks 10 on the reversible bar 6 by attaching one or two of the extension springs 21 to the hooks on the bar and then the opposite end of the extension springs 21 are attached to connecting hook, section 18 located on vertical support rail 2. This completes the connecting method of the left side.

With the user in a sitting position on the floor and facing the invention with both legs extended toward the invention and both legs in a vee-posture, the user grips the reversible bar 6 with both left and right hands using an overgrip near the ends of the bar with both arms fully extended, the bar is then pulled to the lower abdomen of the user and the user then expands the chest and tucks the abdomen in and returns the bar slowly with an opposing force by the user to the starting position, this completes one repetition of this type of exercise.

With the user remaining in a sitting position and legs in a vee-posture and gripping the bar the user can then simulate a forward rowing exercise and then, in a reverse rowing motion.

This is a general form of a large number of exercises that can be performed with the employment of the reversible bar 6, and vertical support rails 2 and 3.

The invention will employ two hand grips of a common type, not shown, they are to be employed in conjunction with the extension springs 21 and the connecting hooks on vertical support rails, 2 and 3.

The number of extension springs 21 to be employed with the two hand grips will vary from one to four depending upon the exercise being performed. One performance ofan exercise can be performed by attaching the springs 21 to the connecting hooks at section 14, for the right hand and section 15, for the left hand. The user stands a step in front and with back to the invention, with hands raised to shoulder height while gripping the grips and elbows pointed to the floor. The grips are pushed forward until the arms are fully extended and parallel to the floor. The grips are then returned slowly with an opposing force by the user stopping at the starting position, completing one repetition in the performance of this type of exercise.

This is a general form of a large number of exercises that can be performed with the employment of the hand grips.

The invention is designed to be used with a wheel-chair. With the employment of the reversible bar 6 and header support rail 1, the user and the wheel-chair are facing the invention. With the user raising his arms and gripping with palms down the two ends of the bar, and with arms raised and extended, with a pulling motion in a downward direction until reaching the area of the knees, then with an opposing force by the user, the bar is slowly raised to its starting position, completing one repetition of this type of exercise employed with the reversible bar 6.

Another form of exercise that can be performed with the wheel-chair and the two hand grips can be accomplished by placing the wheel-chair with back of the user to the invention. The extension springs 21 with the two hand grips are then attached to connecting hook, section 16 for the right hand and connecting hook, section 17 for the left hand, the user then raises the hand grips to shoulder height while gripping the hand grips and elbows pointed to the floor, then the hand grips are pushed forward until arms are fully extended and parallel with the floor, and the hand grips are slowly returned with an opposing force by the user stopping at the starting position, completing one repetition in the performance of this type of exercise with the use of a wheel-chair, and the two hand grips. This is a general form of a large number of exercises that can be performed with the invention and a wheel-chair.

What is claimed as new:

1. An exercise apparatus for use with a conventional door jamb comprising:

support members including an upper support member to be affixed horizontally on the header portion of the door jamb, and a pair of elongated support members to be affixed vertically on opposite sides of the door jamb facing each other in a bi-lateral relationship, each support member including means for securing the support member to the door jamb, and the elongated support members being sized to extend substantially along the entire vertical extent of the door opening:

a plurality of open end eyelets mounted on each support member;

a plurality of resilient members, each resilient member having looped ends; and, a bar having a pair of gripping portions surrounding a central portion, the central portion including a plurality of open end eyelets, wherein the looped ends of the resilient members are detachably connectable to the open end eyelets of the bar and support members.

2. The exercise apparatus of claim 1 wherein the open end eyelets have outwardly turned ends for receiving and guiding the looped ends of the resilient members.

3. The exercise apparatus of claim 2 wherein the ends of the open end eyelets of the elongated support members are turned upwardly.

4. The exercise apparatus of claim 1 wherein the upper supports member includes a plurality of pre-cut slots to adjust the overall length of the upper support member to provide for door jambs of varying widths.

5. The exercise apparatus of claim 1 wherein the bar includes a curved central portion and angled gripping portions, the central portion including two sections of open end eyelets, the sections being located on opposite sides of the bar.

* * * * *